US010850549B2

(12) United States Patent
Seiz

(10) Patent No.: US 10,850,549 B2
(45) Date of Patent: Dec. 1, 2020

(54) HANDLING DEVICE FOR A VALUABLE ARTICLE AND METHOD FOR MANUFACTURING A HANDLING DEVICE

(71) Applicant: Karatbars International GmbH, Stuttgart (DE)

(72) Inventor: Harald Seiz, Stuttgart (DE)

(73) Assignee: Karatbars International GmbH, Stuttgart (DE)

( * ) Notice: Subject to any disclaimer, the term of this patent is extended or adjusted under 35 U.S.C. 154(b) by 0 days.

(21) Appl. No.: 15/409,046

(22) Filed: Jan. 18, 2017

(65) Prior Publication Data

US 2018/0162154 A1 Jun. 14, 2018

(30) Foreign Application Priority Data

Dec. 14, 2016 (DE) ..... 10 2016 124 301

(51) Int. Cl.

| | |
|---|---|
| ***B42D 25/29*** | (2014.01) |
| ***B42D 15/02*** | (2006.01) |
| ***B42D 25/346*** | (2014.01) |
| ***B42D 15/00*** | (2006.01) |
| ***B42D 25/40*** | (2014.01) |

(Continued)

(52) U.S. Cl.

CPC ..... *B42D 25/29* (2014.10); *B42D 15/008* (2013.01); *B42D 15/0086* (2013.01); *B42D 15/027* (2013.01); *B42D 25/285* (2014.10); *B42D 25/328* (2014.10); *B42D 25/333* (2014.10); *B42D 25/346* (2014.10); *B42D 25/355* (2014.10); *B42D 25/373* (2014.10); *B42D 25/40* (2014.10); *B42D 25/41* (2014.10); *B42D 25/45* (2014.10); *B42D 25/475* (2014.10); *B65B 9/02* (2013.01); *B65B 15/00* (2013.01); *B65B 61/04* (2013.01); *B65D 73/0028* (2013.01);

(Continued)

(58) Field of Classification Search

CPC .... B42D 25/29; B42D 25/373; B42D 25/328; B42D 25/333; B42D 25/41; G06Q 99/00; B65D 75/52; B65D 73/0028; B65D 73/0042; B65D 75/30; B65B 61/04; B65B 9/02; B65B 15/00

USPC ..... 206/6.1, 71, 292, 449, 454, 467, 494, 206/524.1, 822; 283/72, 74, 94, 98, 101, 283/109

See application file for complete search history.

(56) References Cited

U.S. PATENT DOCUMENTS

| | | | |
|---|---|---|---|
| 6,128,840 | A | 10/2000 | Boisvert |
| 2005/0072520 | A1 | 4/2005 | Berman |

(Continued)

FOREIGN PATENT DOCUMENTS

| | | |
|---|---|---|
| JP | 2007202692 | 8/2007 |
| WO | 2014001774 | 1/2014 |

OTHER PUBLICATIONS

Brochure of Karatbars International GmbH, "Branding Karatbar", 8 pages, (date unknown—admitted prior art).

*Primary Examiner* — Justin V Lewis

(74) *Attorney, Agent, or Firm* — Lipsitz & McAllister, LLC

(57) ABSTRACT

The invention relates to a handling device for a valuable article that is usable as a means of payment and is of flat extent or punctiform. The handling device comprises a carrier element of flat extent that is foldable and bendable into a wave form and at least one valuable article fixed (Continued)

thereto. Moreover, the invention relates to a method for manufacturing a handling device for a valuable article.

34 Claims, 11 Drawing Sheets

(51) Int. Cl.

| | |
|---|---|
| ***B42D 25/475*** | (2014.01) |
| ***B42D 25/20*** | (2014.01) |
| ***B42D 25/45*** | (2014.01) |
| ***B42D 25/355*** | (2014.01) |
| ***B42D 25/328*** | (2014.01) |
| ***B42D 25/333*** | (2014.01) |
| ***B42D 25/373*** | (2014.01) |
| ***B42D 25/41*** | (2014.01) |
| ***B65B 9/02*** | (2006.01) |
| ***B65B 15/00*** | (2006.01) |
| ***B65B 61/04*** | (2006.01) |
| ***B65D 73/00*** | (2006.01) |
| ***B65D 75/30*** | (2006.01) |
| ***B65D 75/52*** | (2006.01) |
| ***G06Q 99/00*** | (2006.01) |

(52) U.S. Cl.
CPC ..... *B65D 73/0042* (2013.01); *B65D 75/30* (2013.01); *B65D 75/52* (2013.01); *G06Q 99/00* (2013.01)

(56) References Cited

U.S. PATENT DOCUMENTS

| | | | | |
|---|---|---|---|---|
| 2006/0138009 | A1* | 6/2006 | Bozkurt | B65D 75/28 206/467 |
| 2010/0258635 | A1* | 10/2010 | Jones | G06K 19/08 235/487 |
| 2011/0042023 | A1* | 2/2011 | Baker | D21H 21/40 162/110 |
| 2013/0247432 | A1 | 9/2013 | Droz | |
| 2014/0343705 | A1 | 11/2014 | Kessinger | |
| 2015/0224809 | A1* | 8/2015 | Tompkin | B42D 25/328 283/73 |
| 2015/0283845 | A1 | 10/2015 | Marcus | |
| 2016/0075164 | A1* | 3/2016 | Sarrazin | D21H 21/44 283/94 |

* cited by examiner

HANDLING DEVICE FOR A VALUABLE ARTICLE AND METHOD FOR MANUFACTURING A HANDLING DEVICE

This application claims the benefit of German application No. 10 2016 124 301.9 filed on Dec. 14, 2016, which is incorporated herein by reference in its entirety and for all purposes.

FIELD OF THE INVENTION

The present invention relates to a handling device for a valuable article.

The present invention further relates to a method for manufacturing a handling device for a valuable article.

BACKGROUND OF THE INVENTION

The term "valuable article" is used in the present document to mean in particular a physical article other than cash—both coins and banknotes—that, in the view of those involved in private and/or commercial trade, has an intrinsic and inherent value and may thus be accepted and used as a means, instrument or object of payment. Accordingly, the valuable article, or article of value, has a value that is objectifiable in relation to a currency, in particular that is determinable with reference to a price that is constant or variable over time, and at which the valuable article may be traded and exchanged in relation to currency. As a means of payment, the valuable article thus differs from a simple instruction, as is given for example by checks that are used as means of payment, or from a document that may have the nature of a "surety", such as a bill of exchange.

For this reason, the present invention relates to a handling device for a valuable article that is usable as a means of payment and to a method for manufacturing a handling device of this kind.

Valuable articles that have an intrinsic value are for example formed by precious metal or comprise precious metal. Of these, as an example of precious metal, particular emphasis should be put on gold, in particular fine gold. The value of gold is objectively determinable at any time, on the basis of its price in relation to legal currencies. For this reason, gold is internationally acceptable in private and in commercial trade. However, because of its considerable value, gold, which usually takes the form of bars or coins, is not normally indicated as a means of payment for relatively small amounts (for example for purchasing everyday articles), since the denominations which would be required for this do not exist, or the handling of relatively small amounts of gold appears impractical.

It would therefore be desirable to make it easier to handle a valuable article that has an intrinsic value and is usable as a means of payment.

An object underlying the present invention is to simplify the handling of a valuable article that has an intrinsic value and is usable as a means of payment.

SUMMARY OF THE INVENTION

In a first aspect of the invention, a handling device for a valuable article that is usable as a means of payment and is of flat extent or punctiform comprises a carrier element of flat extent that is foldable and bendable into a wave form, and at least one valuable article fixed thereto.

In a second aspect of the invention, a method for manufacturing at least one handling device for a valuable article that is usable as a means of payment and is of flat extent or punctiform comprises providing a carrier element of flat extent that is foldable and bendable into a wave form, and providing and fixing at least one valuable article to the carrier element.

BRIEF DESCRIPTION OF THE DRAWINGS

The foregoing summary and the following description may be better understood in conjunction with the drawing figures. Advantageous embodiments of the handling device in accordance with the invention can be manufactured by means of advantageous exemplary embodiments of the method in accordance with the invention. In the drawings.

DETAILED DESCRIPTION

Figure 1:
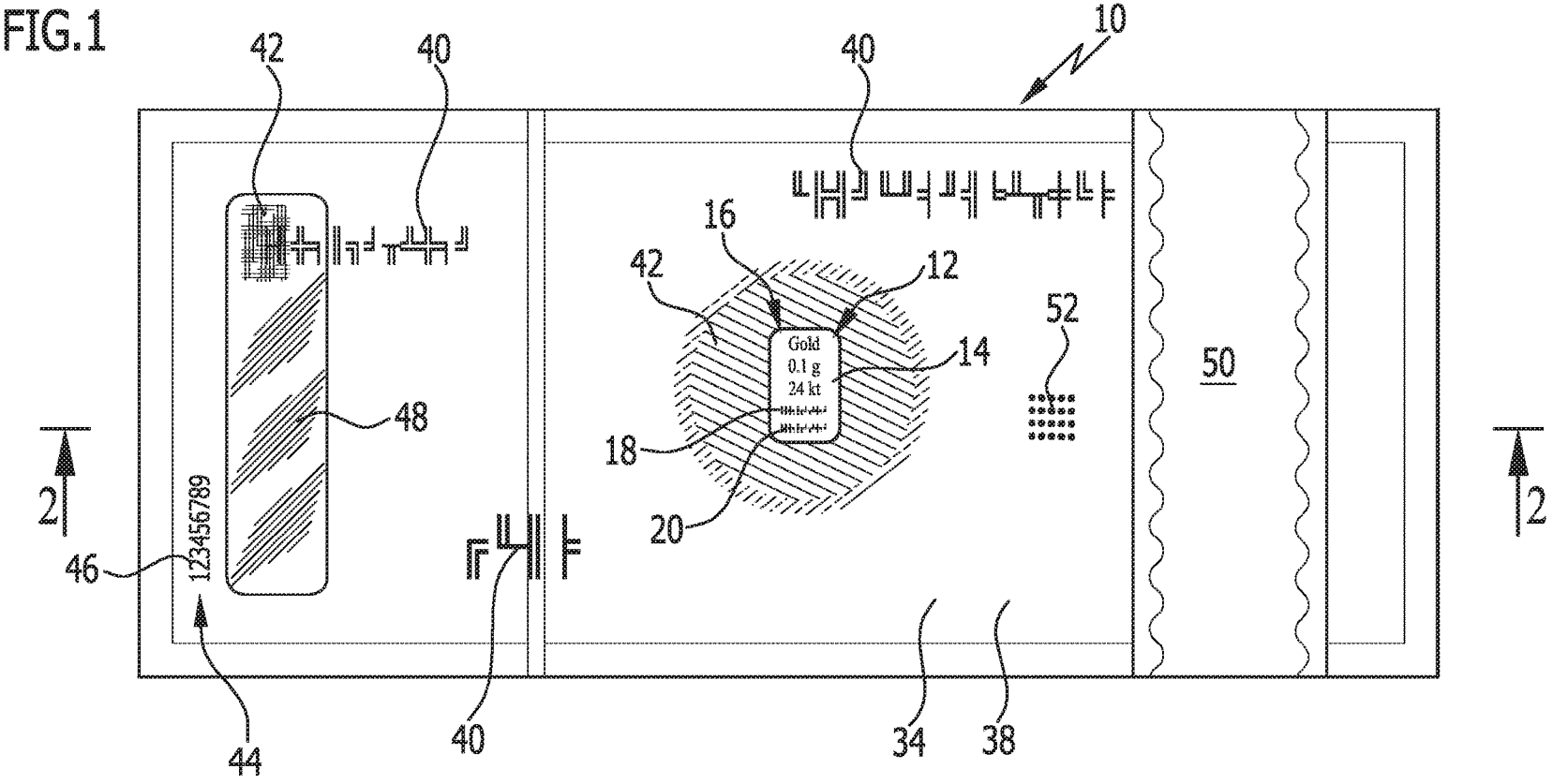
FIG. 1 shows a schematic plan view of a first preferred embodiment of the handling device in accordance with the invention.
Figure 2:
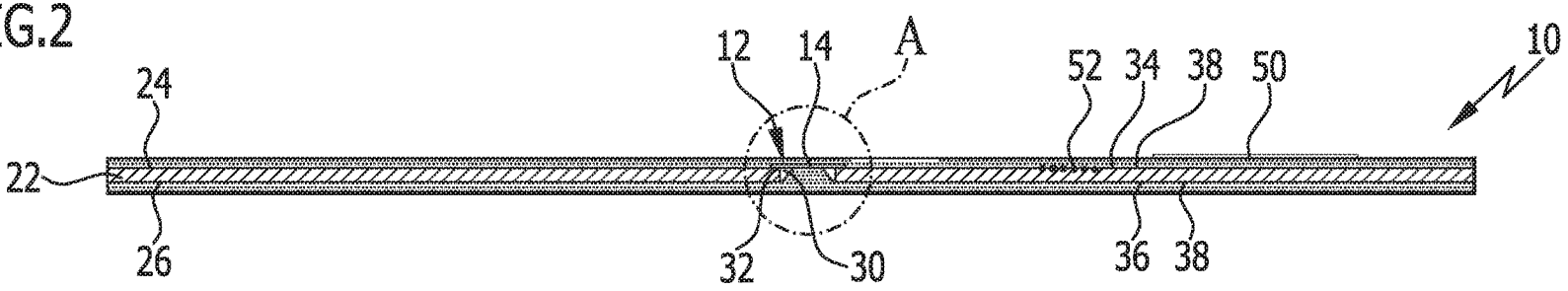
FIG. 2 shows a (schematic) sectional view along the line 2-2 in FIG. 1.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a handling device for a valuable article that is usable as a means of payment and is of flat extent or punctiform. The handling device comprises a carrier element of flat extent that is foldable and bendable into a wave form, and at least one valuable article fixed thereto.

In the handling device in accordance with the invention, a carrier element is provided to which there is fixed, directly or indirectly, at least one valuable article that is usable as a means of payment. This quite considerably simplifies the handling of valuable articles that can be manually handled in isolation only with difficulty because even in a relatively small size they have a not inconsiderable value. This applies for example to gold, when one considers for example amounts that are sufficient for the provision of everyday needs. The carrier element of the handling device in accordance with the invention is of flat extent, bendable into a wave form and foldable and preferably also rollable. The valuable article is of flat extent, for example being in strip or sheet form, and accordingly has a thickness that is significantly less than the extent of the valuable article in at least one of the other two dimensions. The valuable article of flat extent may have any desired shape, for example being rectangular, square, rounded, or circular, with irregular shapes also being conceivable. As an alternative, a punctiform valuable article may be provided, for example approximately of the size of a pinhead. The at least one valuable article may be significantly smaller than the carrier element. Since the carrier element is of flat extent, the handling device has the appearance of a banknote. In addition to the value of the valuable article per se, this has the advantage that the acceptability of the handling device with an integrated valuable article in circulation is further increased. The fact that the carrier element has a shape that is bendable into a wave form and foldable provides the further advantage that the handling device can be handled like a banknote. For example, the handling device with integrated valuable article may be carried around in a purse or briefcase.

The present invention is particularly important for valuable articles that are acceptable and may be used internationally. The handling device with integrated valuable article may be used independently of any national currency and regardless of exchange rates, and independence of the financial system and the respective political order may thus be obtained.

It proves advantageous if the carrier element takes a rectangular form in plan view. This further reinforces the appearance of the handling device as a banknote. Moreover, there is an advantage of simplified manufacture of the handling device, for example if numerous such handling devices are manufactured—as explained below—by means of a plurality of carrier elements on a common sheet, with the result that the rectangular form makes it easier to separate the handling devices or carrier elements from one another.

With a rectangular form of the carrier element, for example dimensions of approximately 10 cm to 20 cm on a longitudinal side and approximately 5 cm to 10 cm on a transverse side of the carrier element prove advantageous.

It will be appreciated that the handling device preferably takes an overall rectangular form in plan view, wherein it may in particular have the dimensions stated above.

It proves favorable if the carrier element is made from a paper material or if the carrier element is formed as a plastics foil. This enables the handling device to be manufactured simply and inexpensively. In an advantageous embodiment, the grammage of a carrier element made from a paper material may for example be approximately 50 to 150 g/m$^2$, in particular approximately 100 g/m$^2$.

The thickness of the carrier element may be for example approximately 50 μm to approximately 150 μm, preferably approximately 100 μm.

In an advantageous implementation of the handling device, it is provided for the at least one valuable article to be in strip form.

Advantageous embodiments of the handling device have for example a valuable article with a thickness of approximately 5 μm to 60 μm, for example approximately 10 μm to 50 μm.

Preferably, the at least one valuable article is chemically inert, as a result of which its value may be retained over the long term. Even if the carrier element is destroyed, for example by being broken up dissolved or burned, the at least one valuable article and its value are retained.

As mentioned in the introduction, it is favorable if the at least one valuable article is a precious metal, consists of a precious metal or comprises such a precious metal. The valuable article is in particular formed by the precious metal. An alloy of the precious metal with a further metal (precious or otherwise) may also be provided. The use of a precious metal proves technically simple and practicable when using the handling device whereof the valuable article is acceptable as a means of payment in numerous countries.

In a particularly advantageous embodiment of the invention, the precious metal is gold or platinum, wherein in particular fine gold (24-karat gold) has proved advantageous. The precious metal, in particular gold, may for example be in a strip form of flat extent, as a "bar", for example having a thickness of approximately 5 μm to 60 μm and with other dimensions approximately in the cm range. Gold is in particular characterized in that it is largely chemically inert and the handling device with integrated valuable article has a high level of stability and in particular stability of value. Further, the ductility of gold has proved advantageous in using it as the valuable article. The fact that plastic deformation is possible when bending the carrier element into a wave form or folding or rolling it leaves the valuable article undamaged.

In practice, a mass of approximately 0.025 g to 0.5 g, preferably approximately 0.1 g to 0.2 g, of the precious metal has proved advantageous for the at least one valuable article. For example, when using fine gold as the precious metal, with a mass of approximately 0.1 g for the valuable article the market value as at the application date is approximately 3 dollars to 5 dollars. This provides the possibility of making gold easy to handle in small amounts as well, even for the provision of everyday needs. As an additional point, it may be provided for a plurality of handling devices to be used with one valuable article each, or—as explained below—for the handling device to comprise more than just one valuable article.

It is advantageous if the at least one valuable article has an identifier by way of which the value and/or origin of the at least one valuable article is verifiable. For example, the amount or mass of the valuable article may be identified and/or there may be a certification of the valuable article. This makes it possible for users to determine the value of the valuable article in a simple manner. When gold is used as the valuable article, there is for example a hallmark or a certification mark, in particular an LBMA (London Bullion Market) certification. The provision of the identifier and in particular the certification further makes it possible to increase the acceptability of the handling device and to prevent tampering.

It is favorable if the handling device includes a plurality of valuable articles, preferably identical in form. A plurality of valuable articles may be fixed to one carrier element. It is not necessary to provide separate carrier elements. This makes it easier to handle a plurality of valuable articles. Preferably, the plurality of valuable articles are identical in form and are identical in value.

If a plurality of handling devices is provided, it is possible for there to be handling devices having different numbers of valuable articles. In this way, the handling devices permit the total value to give different denominations, as in the case of banknotes. "Units" of valuable articles may so to speak be provided, for example with one, two, four and/or six valuable articles.

It has proved advantageous if the at least one valuable article is fixed to the carrier element by adhesion in order to enable reliable fixing of the valuable article. The use of a waterproof adhesive is conceivable, in order to ensure that the valuable article is fixed as permanently as possible. As an alternative, the use of an adhesive that can be dissolved by a solvent such as water may be provided, in order to enable the valuable article to be easily detached from the carrier element if necessary. The at least one valuable article may be fixed to the carrier element directly by adhesion, or indirectly, for example by way of the cover element mentioned below.

It may be provided for the at least one valuable article to be non-detachably fixed to the carrier element in order to ensure the stability of the handling device.

As an alternative, it is conceivable for the at least one valuable article to be detachably fixed to the carrier element. This is advantageous for example in the case of a valuable article that is formed by a precious metal, in particular gold, if a different use is intended for the gold.

The at least one valuable article may in particular be fixed on a surface, one of the sides of the flat carrier element, in particular by adhesion.

In an advantageous implementation of the handling device, it is favorable if the carrier element has at least one through opening, to the rim of which the at least one valuable article is fixed. This provides the possibility of recognizing the valuable article from both sides of the carrier element. This makes handling easier for a user, since it is not necessary to turn the handling device over in order to recognize the at least one valuable article.

If, as mentioned above, a plurality of valuable articles is provided, a plurality of through openings may be provided on the carrier element, in which case one through opening is associated with each valuable article.

The at least one valuable article is connected to the rim of the at least one through opening for example by adhesion to the carrier element, and is thus fixed thereto securely and over the long term.

In an advantageous embodiment of a different kind, it is favorable if the carrier element has at least one through opening, within which the at least one valuable article is positioned with positive engagement. This for example provides the possibility of integrating the valuable article within the layer of the carrier element such that the valuable article does not project, or does not substantially project, beyond a surface of the carrier element. In the present document, the term "positioned with positive engagement" includes the possibility that the at least one valuable article is connected for example at the outer periphery by adhesion to a rim of the at least one through opening.

With a plurality of valuable articles, a plurality of through openings may be provided on the carrier element, in which case one through opening is associated with each valuable article.

The feel of the handling device in the hand, and hence the handling thereof, may be improved if the at least one valuable article is arranged on the carrier element such that the valuable article does not project, or does not substantially project, beyond a surface of the carrier element. As mentioned in the introduction, this may reinforce the appearance of the handling device as a banknote.

It is favorable if the handling device comprises at least one transparent cover element that covers the carrier element on one side. The cover element is preferably layer- or film-like, and serves in particular to protect the carrier element and advantageously the valuable article fixed thereto. Advantageously, two cover elements are provided, arranged on mutually remote sides of the carrier element.

The at least one cover element advantageously covers the at least one valuable article such that the latter is fixed to the carrier element and/or protected more reliably.

For implementation of the handling device, it is favorable if the at least one cover element is formed by a foil that is applied to the carrier element and is for example laminated on.

The dimensions of the at least one cover element in the direction in which it is of flat extent preferably correspond with those of the carrier element.

An advantageous embodiment of the handling device in accordance with the invention provides for the at least one valuable article to be fixable to the at least one cover element, wherein the at least one cover element engages in at least one through opening in the carrier element, at the rim of which or in which the at least one valuable article is fixed. For example, the at least one cover element is applied such that it engages in the through opening from a side of the carrier element opposite the valuable article. The valuable article may abut against the rim of the through opening or be positioned with positive engagement in the through opening. For example, the at least one valuable article may be fixed to the cover element by means of an adhesive. The cover element advantageously undergoes plastic deformation when it is applied such that the cover element engages in the through opening, in certain sections. This is possible for example in the case of a foil that is laminated on as mentioned above.

The carrier element may be provided with identifying elements of a graphical type, which have graphical characters and/or design elements or decorations. The identifying elements may in particular be applied by being printed onto the carrier element.

Identifying elements and/or security features advantageously serve to increase the security, in that the handling device is better protected against tampering. Moreover, a verification of whether the at least one valuable article is genuine may be dispensed with if it can be verified that the handling device as a whole is genuine.

For example, the handling device may include an identification feature by means of which the handling device is unambiguously identifiable. The identification feature includes for example alphanumeric characters and is preferably formed by a serial number that is applied, for example printed, on the carrier element. By means of the serial number a respective handling device and the valuable article thereof may favorably be unambiguously identified throughout the world.

It proves favorable if the carrier element includes at least one watermark. This allows the handling device to be better protected against tampering.

For the same purpose, it is favorably provided for the handling device to have at least one hologram or kinegram.

The at least one hologram or kinegram is for example applied to the carrier element.

As an alternative, it is favorable, when the handling device has the above-mentioned transparent cover element, if the at least one hologram or kinegram is applied to the cover element. The reflecting or shimmering effect of the hologram or kinegram is better utilized in this way than if it is applied to the carrier element and arranged below the cover element. As a result of this effect, the handling device is at the same time better protected against tampering, because the requirements regarding the quality of the hologram or kinegram are increased and imitation is made more difficult.

The hologram or kinegram may for example be applied by hot stamping onto the cover element or the carrier element.

It has already been mentioned that an identification feature for unambiguous identification of a respective handling device may be provided.

Similarly, it is advantageous if the handling device includes or forms an analyzable marking element by means of which the origin of the handling device is verifiable. The marking element may accordingly form an indication of the issuer of the handling device with integrated valuable article. An analysis of the marking element allows the issuer to be unambiguously identified, as a result of which it becomes more difficult to tamper with handling devices.

The marking element is for example applied to the carrier element, below the cover element if there is one.

In practice, it proves favorable if the marking element is or comprises a synthetic DNA element (S-DNA element). Synthetic DNA elements consist of or comprise for example substances or media that can be detected by chemical or physical analysis (such as sequencing, spectral analysis, mass spectrometry and so on) and/or whereof the composition can be determined by an analysis of this kind. Conventional examples are synthetic DNA elements based on nucleotides or ceramic. The S-DNA element may be or comprise a solid or a liquid.

As an alternative or in addition, a marking element may be provided in the form of a so-called "microdot", which may have alphanumeric characters and/or graphical elements in miniaturized form, which can be made visible under high magnification.

As mentioned in the introduction, the present invention also relates to a method. A method in accordance with the invention for manufacturing at least one handling device for a valuable article that is usable as a means of payment and is of flat extent or punctiform comprises the following steps:

- providing a carrier element of flat extent that is foldable and bendable into a wave form; and
- providing and fixing at least one valuable article on the carrier element.

Using the method in accordance with the invention, a handling device of the above-mentioned type can be manufactured. The advantages thereof have already been discussed, so to avoid repetition the reader may be referred to the statements above.

Advantageous exemplary embodiments of the method in accordance with the invention become apparent from advantageous embodiments of the handling device in accordance with the invention.

In this regard, reference may likewise be made to the embodiments above.

Some particularly advantageous exemplary embodiments of the method are given below.

Favorably, the at least one valuable article is or consists of a precious metal or comprises such a precious metal. The valuable article may be formed by precious metal. Preferably, the precious metal is gold or platinum, in particular fine gold.

The valuable article is preferably placed on the carrier element mechanically, for example by means of a robot arm.

The at least one valuable article is advantageously fixed to the at least one carrier element by adhesion. Adhesive is preferably applied mechanically.

It is favorable if an optically transparent cover element is applied to the carrier element on at least one side and preferably two mutually remote sides, wherein the cover element is in particular applied such that it covers the at least one valuable article.

The cover element is for example formed by laminating a foil onto the carrier element.

Favorably, the at least one cover element engages, in certain sections, in at least one through opening in the carrier element, wherein the at least one valuable article is connected to the at least one cover element, for example by adhesion.

The carrier element may preferably be provided with identifying elements that are for example applied to the carrier element.

It is favorable if an analyzable marking element by means of which the origin of the handling device is verifiable is applied, preferably to the carrier element.

It is advantageous if at least one hologram or kinegram is applied, for example by hot stamping, preferably on the at least one cover element.

The method may in particular provide for a plurality of handling devices to be manufactured. A method of this kind may be characterized in that a multiplicity of carrier elements is provided on a sheet, and in that, after the respective at least one valuable article has been fixed to the carrier element, the sheet is divided into individual handling devices. It will be appreciated that further manufacturing steps may be performed after the at least one valuable article has been applied, and before the dividing. For example, a cover element is applied to the carrier element, in particular above the at least one valuable article. A hologram or kinegram may in particular be applied to the cover element. The analyzable marking element may be applied before or after the at least one valuable article has been fixed.

In an advantageous exemplary embodiment of the method, the procedure may for example be as follows:

A sheet having a multiplicity of carrier elements made from a paper material is provided, for example having a grammage of 100 g/m$^2$ and/or a thickness of approximately 100 μm. For example, a sheet having a size of approximately 50 cm×70 cm is used, with other dimensions of the sheet also being possible. The sheet may be printed with identifying elements and/or identification features, for example by color printing, or identified in another way.

At least one through opening is formed in the respective carrier element, and at least one valuable article is fastened to the rim of the through opening. The through openings are formed in the sheet for example by a laser. This makes it possible to respond to any dimensional tolerances in the dimensions of the valuable articles quickly and flexibly, and where required to make adjustments.

A precious metal, in particular gold, is provided as the valuable article, in the form of a gold bar in strip form, for example having a weight of approximately 0.1 g. The gold is fixed to the rim of the through opening by adhesion to the carrier element.

A cover element may be applied to the sheet by laminating on a foil. The cover element is applied to the side of the sheet remote from the bar.

An analyzable marking element in the form of an S-DNA element is printed onto the carrier element by means of a printer head. The S-DNA element comprises for example a substance based on ceramic that is analyzable physically and/or chemically.

A cover element is applied to the side of the carrier element to which the gold is fixed. The cover element preferably covers the entire carrier element, including the gold.

Advantageously, a hologram or kinegram is mounted on the cover element by hot stamping. The hologram or kinegram may be integrated in a foil.

A multiplicity of handling devices is cut out of the sheet, for example with the aid of a laser.

The present invention also relates to a handling device that is manufactured by a method of the above-mentioned type.

FIGS. 1 to 10 illustrate an advantageous embodiment, designated as a whole by the reference numeral 10, of a handling device in accordance with the invention. The handling device 10 serves for simplified handling of an integrated valuable article 12. In the present case, the valuable article 12 is a precious metal, in particular gold and specifically fine gold (24-karat gold).

The gold takes a shape in strip form of flat extent, as a thin bar 14. In the handling device 10, the thickness of the bar 14 is approximately 5 μm to 20 μm, for example approximately 10 μm. With a mass of 0.1 g, the dimensions of the bar 14, which is approximately rectangular in plan view, are approximately 1 cm to 1.5 cm along the longitudinal side and approximately 0.5 cm to 1 cm along the transverse side.

The dimensions in the plane of the handling device 10 are thus markedly greater than the dimension perpendicular to the plane of the handling device 10.

Figure 3:
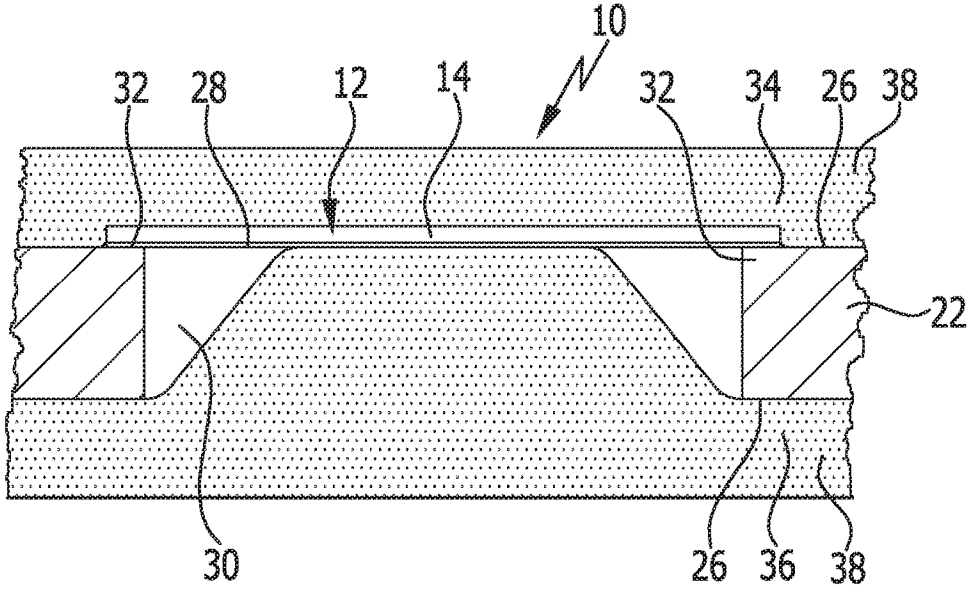
FIG. 3 shows an enlarged representation of detail A in FIG. 2.
Figure 4:
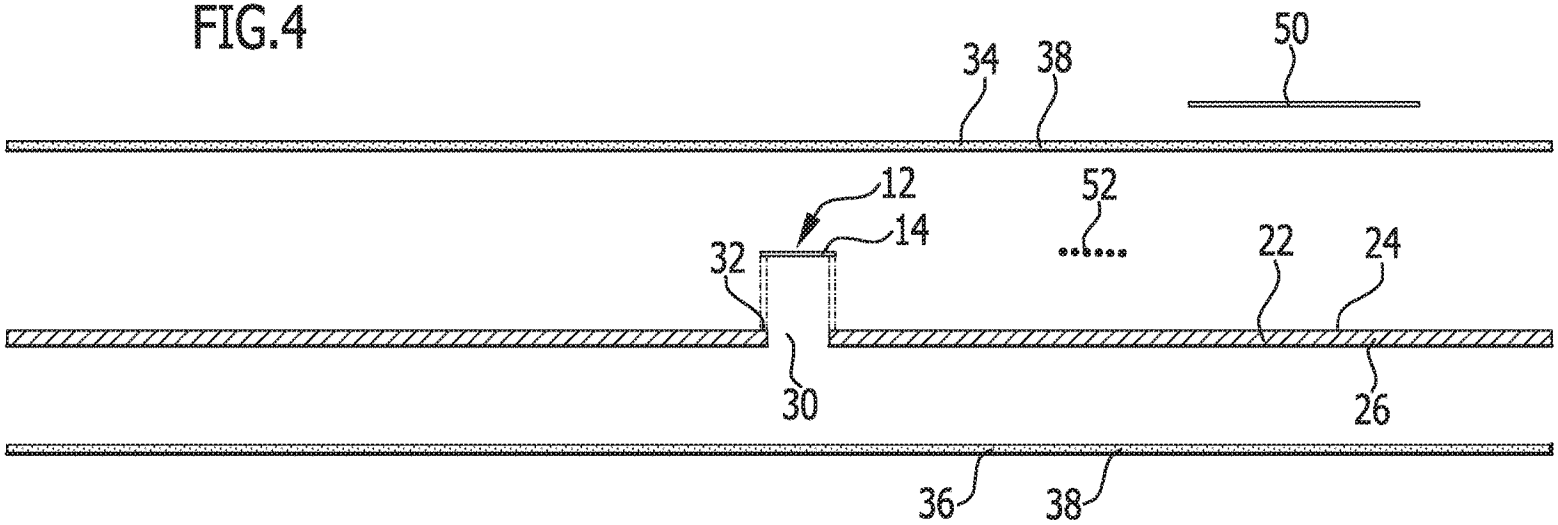
FIG. 4 shows an exploded representation of the handling device from FIG. 1, in a side view.
Figure 5:
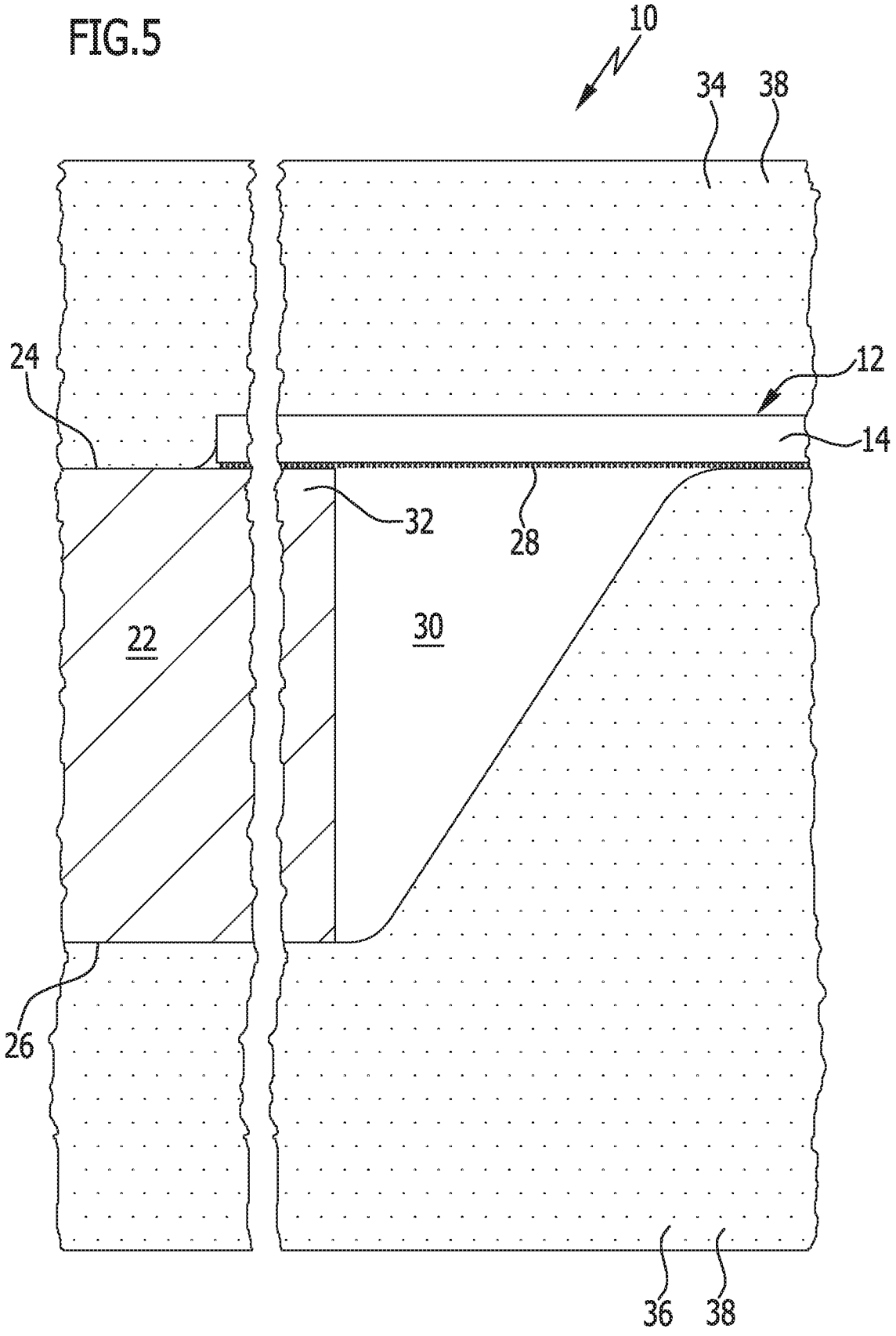
FIG. 5 shows an enlarged partial representation of FIG. 3, approximately to scale.

The drawing includes only a schematic representation of the handling device 10 and of the further handling devices. For example, FIGS. 2 to 4, 9 and 10 are not to scale. The representation in accordance with FIG. 5 is approximately to scale as regards the respective thickness of the bar 14, the carrier element and the cover elements.

Instead of the shape of the bar 14 that is approximately rectangular in plan view, in another type of embodiment a different shape could be provided. For example, the bar 14 could be square, rounded, in particular circular, or of irregular shape.

The valuable article 12 that is formed by gold has an inherent, objectifiable value and is acceptable as a means of payment in many countries. The value of the valuable article 12 may be determined from prices in relation to a multiplicity of currencies. For example, the value of the bar 14 (for example with a weight of 0.1 g of fine gold) as at the application date of the present patent application is approximately 3 dollars to 5 dollars.

For use as a means of payment, however, in isolation the bar 14 has proved difficult to handle because of the considerable value of gold. For this purpose, the handling device 10 in accordance with the invention is provided with an integrated valuable article 12.

The bar 14 may have, on at least one side, an identifier 16 by means of which the quantity and/or the karat rating of the gold may be indicated. Further, the identifier 16 may comprise information 18 on the origin of the bar 14, and a certification 20, for example an LBMA mark. An identifier 16 may be provided on both sides of the bar 14.

The handling device 10 comprises a carrier element 22. The carrier element 22 is in the present case made from a paper material, for example having a grammage of 100 $g/m^2$. The thickness of the carrier element 22 is for example approximately 100 μm.

The carrier element 22 is of flat extent and has dimensions of approximately 10 cm to 15 cm along a longitudinal side and approximately 5 cm to 10 cm along a transverse side. In plan view, the carrier element 22 is rectangular.

The carrier element 22 has a first side 24 and a second side 26 that is remote from the first side 24. In the present case, the bar 14 is fastened to the first side 24 of the carrier element 22. In the case of the handling device 10, the fixing is performed by adhesion using an adhesive. The adhesive 28 is advantageously transparent to visible light.

In the present case, the adhesive 28 is substantially insoluble, but in particular is not soluble by most or the most common solvents, specifically water. This makes it possible to ensure a high level of stability of the handling device 10, and largely to prevent the bar 14 from being detached from the carrier element 22.

As an alternative, it may be provided for an adhesive 28 that is for example water-soluble to be used. This is advantageous for example if it is assumed that a user might intend to detach the bar 14 from the carrier element 22 and put it to another use.

In the carrier element 22 there is formed a through opening 30 from the first side 24 to the second side 26. The through opening 30 is arranged for example approximately centrally in the carrier element 22. The through opening 30 is bordered by a rim 32. The bar 14 is fixed to the rim 32 by means of the adhesive 28 (FIGS. 3 and 4). In this case, the bar 14 lies on the surface of the carrier element 22. The overlap at the rim 32 between the bar 14 and the carrier element 22 is for example less than 1 mm, for example approximately 250 μm.

The through opening 30 provides the possibility of recognizing the bar 14 from both sides without a user having to turn the handling device 10 over for this purpose.

The handling device 10 further includes two cover elements 34, 36 that respectively cover one side 24 and 26. In the present case, the cover elements 34, 36 are formed by foils 38 that are applied to the carrier element 22, in particular by being laminated. Both foils 38 are optically transparent and extend over the entire surface of the carrier element 22, on both sides 24, 26.

The thickness of the foils 38 is for example approximately 50 μm to 100 μm, in the present case approximately 65 μm.

On the first side 24, the foils 38 also cover the bar 14, with the result that it is better protected from access from the outside and is additionally indirectly fixed to the carrier element 22. Depending on the thickness of the bar 14 and/or the nature of the foil 38, the latter may have a bulge or raised portion (indicated in FIG. 10), unlike the planar representation in the drawing.

The foil 38 on the second side 26 is applied such that the foil 38 engages in the through opening 30 from the opposite side to the bar 14. For example, the laminating procedure for the foil 38 results in a plastic deformation, such that the foil 38 expands in certain sections in the through opening 30.

This provides the particular advantage that the bar 14 can also be connected to the foil 38 on the second side 26. For this purpose, it may advantageously be provided for the adhesive 28 to be applied to the bar 14 not only in the region of the rim 32 but also in the region of the through opening 30. For example, substantially the entire rear side of the bar 14 may be provided with adhesive 28. The section of the foil 38 that engages in the through opening 30 may in this way be adhered to the bar 14, and the latter may consequently be fixed even more reliably.

The foils 38 serve as a protection for the carrier element 22 and the bar 14. They may thus also be designated a protective layer or protective film.

Advantageously, the foils 38 are water-repellent in order to protect the carrier element 22 from water and to prevent them from becoming soggy.

Figure 6:
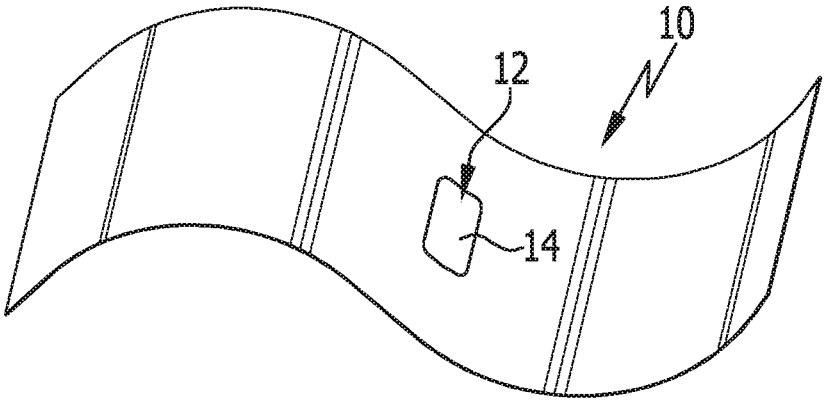
FIG. 6 shows the handling device from FIG. 1, in a condition bend into a wave form.
Figure 7:
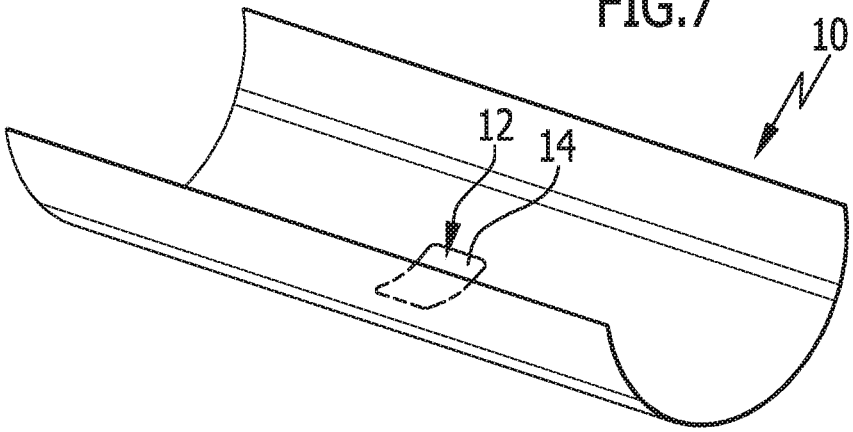
FIG. 7 shows the handling device from FIG. 1, in a condition bend into another type of wave form.
Figure 8:
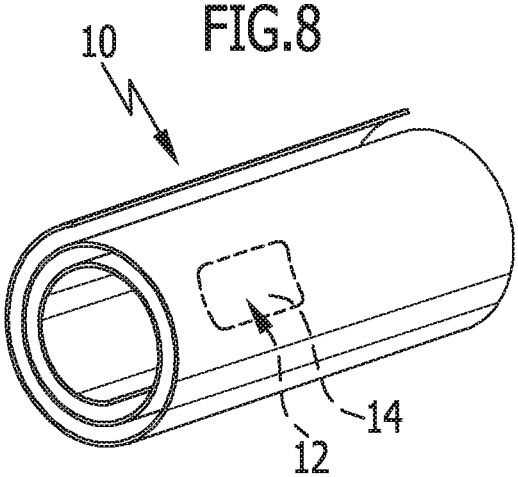
FIG. 8 shows the handling device from FIG. 1, in a rolled condition.

Because of the shape of the carrier element 22 and the foils 38 covering the handling device 10, including the dimensions, the handling device has the appearance of a banknote. Because it is of flat extent, the carrier element 22, together with the applied foils 38, and thus the handling device 10, are bendable into a wave form and rollable (FIGS. 6 to 8).

Figure 9:
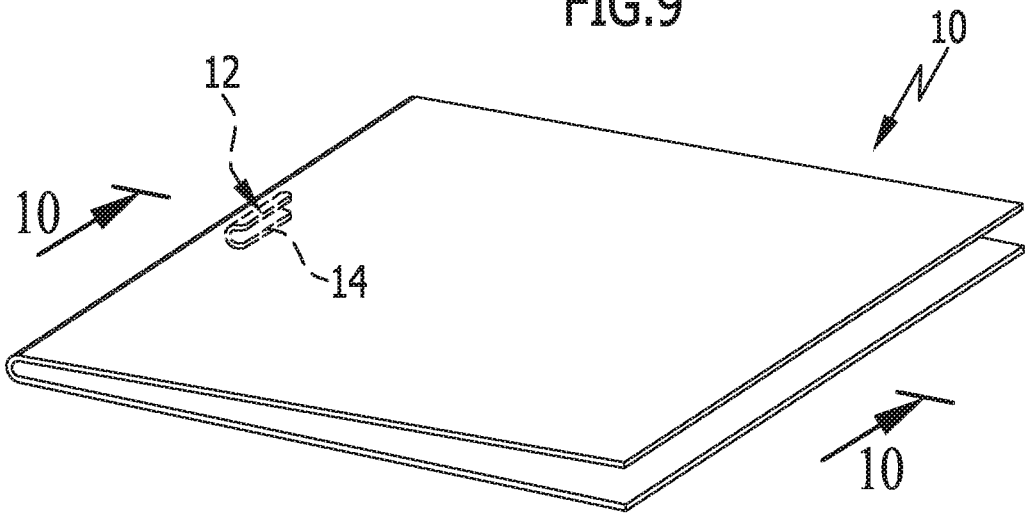
FIG. 9 shows the handling device from FIG. 1, in a folded condition.
Figure 10:
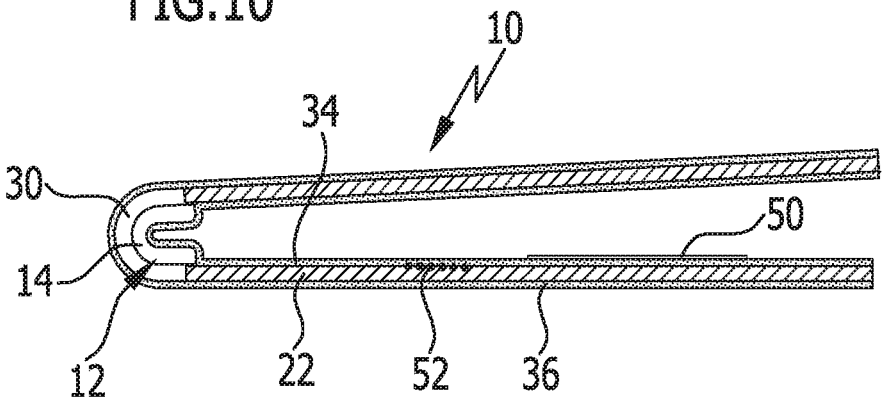
FIG. 10 shows a schematic sectional view along the line 10-10 in FIG. 9.

Moreover, the carrier element 22, together with the applied foils 38, and thus the handling device 10, is foldable (FIGS. 9 and 10). Because of the gold in the form of a bar 14, which is likewise of flat extent, it is even possible to fold the handling device 10 such that the fold line passes through the bar 14. Because of the ductility of gold, the bar 14 itself remains undamaged.

Figure 11:
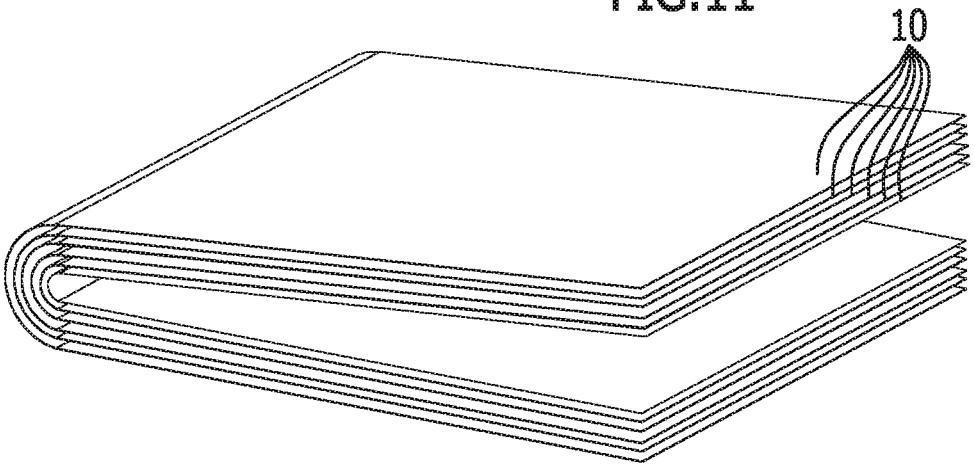
FIG. 11 shows a representation corresponding to FIG. 10, with a folded bundle of a plurality of handling devices.

The remarks above show that the handling device 10 with integrated valuable article 12 does not only have the appearance of a banknote but may also be handled like a banknote. Bending into a wave form, rolling, folding, crumpling, creasing: all are possible with the handling device 10. It is even possible to fold a plurality of handling devices in a manner similar to a bundle of stacked banknotes, as represented schematically in FIG. 11.

The handling device 10, in particular the carrier element 22 thereof, may have identifying elements. For example, the identifying elements are printed on the carrier element 22. The drawing schematically shows placeholders for alphanumeric character strings 40 and embellishments 42. The identifying elements may in particular identify the origin of the handling device 10, that is to say the issuer of the handling device 10.

The handling device 10 may advantageously comprise security features for protecting from tampering. For example, there is provided as a security feature an identification feature 44. The identification feature 44 in the present case is a serial number 46 that is applied to the carrier element 22, in particular being printed on. The serial number 46 is advantageously unambiguous throughout the world, so that any handling device 10 can be identified unambiguously.

Further, a watermark 48 may be provided in the carrier element 22 as a security feature.

In particular, a hologram 50 is provided as a further security feature. The hologram 50 in the present case takes a form in the manner of a foil and is applied to the cover element 34 that covers the first side 24 of the carrier element 22. The hologram 50 is for example applied by hot stamping.

As an alternative or in addition to the hologram 50, a kinegram may be provided.

An analyzable marking element 52 is provided as a further security feature. The marking element 52 in the present case takes the form of synthetic DNA (so-called S-DNA) that is based on a ceramic, for example in powder form. Physical and/or chemical analysis allow the marking element 52 to be analyzed. From the information contained, the manufacturer of the handling device 10 can be unambiguously identified and hence the origin thereof verified.

The marking element 52 is applied to the first side 24 and is arranged below the foil 38.

Figure 12:
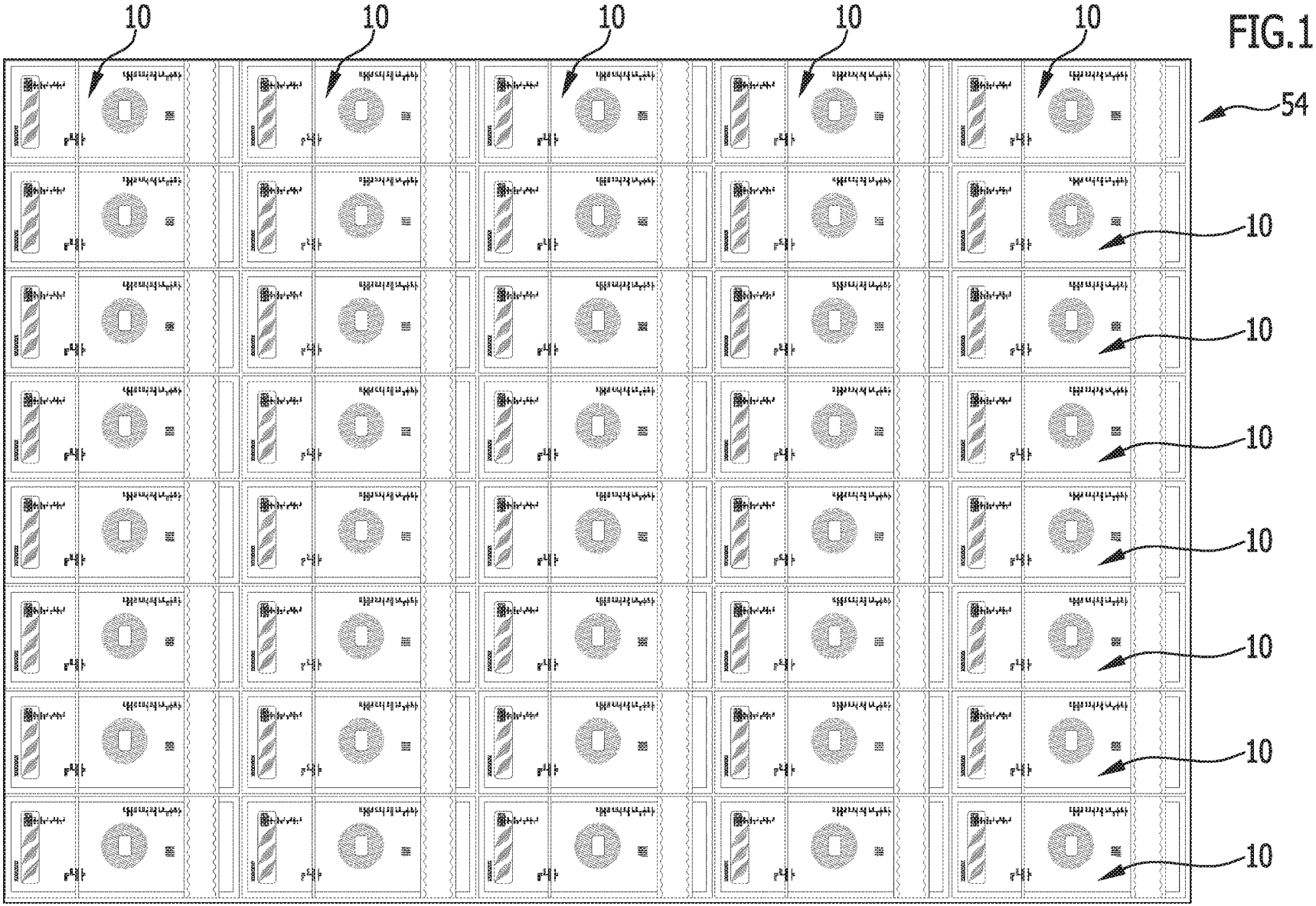
FIG. 12 shows a plan view of a multiplicity of mutually connected, not yet separated handling devices that have been manufactured using a printable sheet.
Figure 13:
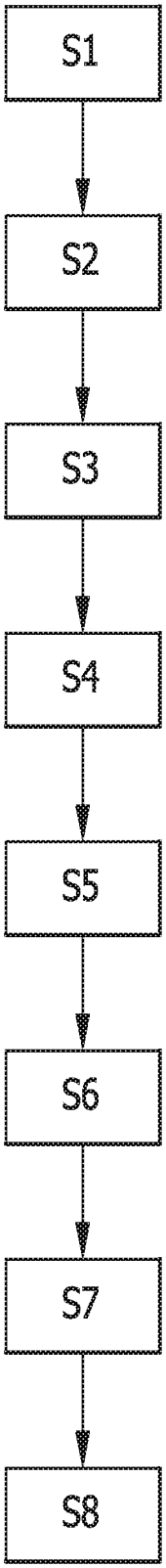
FIG. 13 shows schematically the sequence of a method for manufacturing the handling device from FIG. 1.

Below, a method for simultaneously manufacturing a multiplicity of handling devices 10 is discussed with particular reference to FIGS. 12 and 13.

First, in a method step S1, a sheet 54 is provided that comprises a multiplicity of carrier elements 22, preferably in a regular arrangement, for example in rows and columns.

The sheet 54 is preferably made from a paper material and, in the method step S1, is advantageously already printed. Thus, in particular the character strings 40, the embellishments 42 and the serial numbers 46 may already be printed onto the sheet 54. The sheet 54 comprises a watermark 48 associated with each carrier element 22.

The sheet 54 has for example dimensions of approximately 50 cm×70 cm, the grammage may be for example 100 g/m$^2$, and the thickness may be approximately 100 μm.

In a subsequent method step S2, through openings 30 are formed in the sheet 54, one through opening 30 being associated with each carrier element 22. The through openings 30 are formed for example by means of a laser cutting method.

In a subsequent method step S3, it may be provided for the cover element 36 to be applied to the second side 26 of the sheet 54. The cover element that is formed by the foil 38 is preferably laminated onto the sheet 54. As mentioned above, in a preferred embodiment this may be performed such that the foil 38 engages in the through openings 30 in certain sections.

In the subsequent method step S4, the bars 14 are applied to each carrier element 22 in that they are glued to the carrier element 22 using adhesive 28. The bars 14 may be fixed manually or, preferably, mechanically. Adhesion to the foil 38 on the second side 26 is preferred.

The subsequent method step S5 provides for the synthetic DNA that is formed by the marking element 52 to be applied to each carrier element 22 by means of a printer head.

In a subsequent method step S6, the foil 38 forming the cover element 34 is applied to the first side 24 of the sheet 54, covering the bars 14 as well. The foil 38 is laminated to the sheet 54.

It will be appreciated that the foils 38 in the method steps S3 and S6 are preferably dimensioned such that they each cover the entire sheet 54. The multiplicity of carrier elements 22 may thus be provided with the foils 38 simultaneously. Separate lamination of individual foils 38 onto each carrier element 22 is not required.

In a subsequent method step S7, the hologram 50 is applied to the foil 38 that forms the cover element 34. For this purpose, a strip of holograms 50 may for example be associated with each column of carrier elements 22. For this, for example a roll of holograms 50 may be rolled over adjacent handling devices 10 such that a strip of successive holograms 50 is produced. Then the strips of holograms 50 are fixed to the foils 38 by hot stamping.

In a subsequent method step S8, the sheet 54 is cut to size and divided into individual handling devices 10, for example by means of a laser cutting method.

Below, further advantageous embodiments of the handling device in accordance with the invention are discussed. For like or equivalent features and components, identical reference numerals are used. The advantages that have already been mentioned in conjunction with explaining the handling device 10 may likewise be obtained with the other handling devices. To avoid repetitions, the reader may thus be referred to the remarks above. Only the most important differences are discussed.

Figure 14:
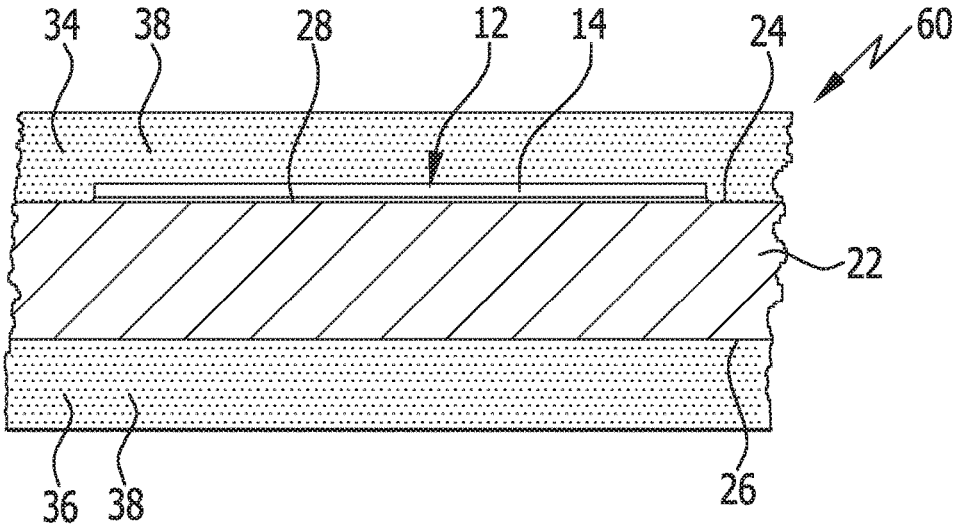
FIG. 14 shows a representation corresponding to FIG. 3, in a second preferred embodiment.

FIG. 14 shows, as a detail, a sectional view through a handling device that is designated by the reference numeral 60. The handling device 60 is not provided, in the carrier element 22, with a through opening 30 against the rim 32 whereof the bar 14 abuts. The carrier element 22 has no perforations at all.

Figure 15:
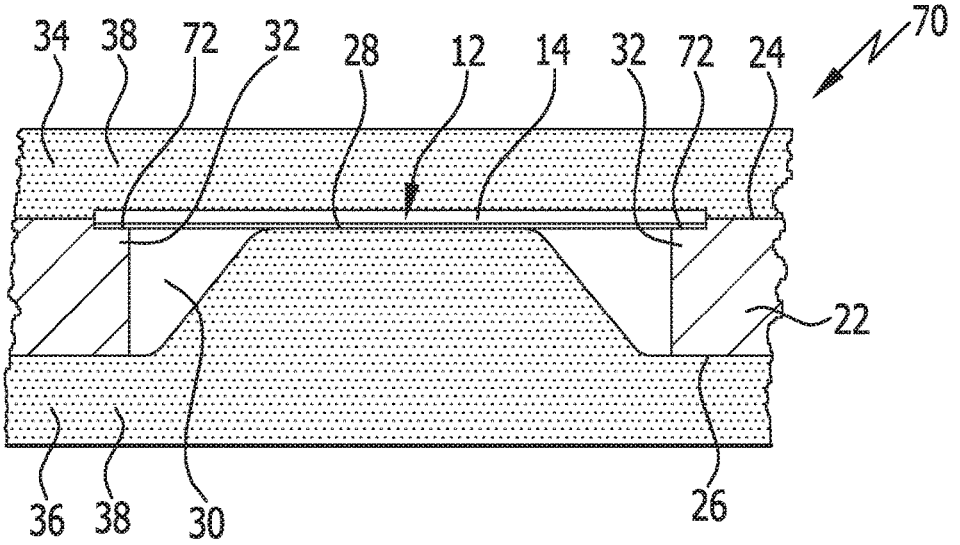
FIG. 15 shows a representation corresponding to FIG. 3, in a third preferred embodiment.

In the case of a handling device 70, represented partly in sectional view in FIG. 15, the through opening 30 is provided. However, unlike the case of the handling device 10, the through opening 30 does not have a constant cross section. Instead, two sections of different cross section are formed on the through opening 30, with the result that the rim 32 is formed by a shoulder 72.

The bar 14 lies on the shoulder 72 and is fixed thereto by adhesive 28.

Depending on the thickness of the carrier element 22 and the thickness of the bar 14, it may be provided for the bar 14 to project upward beyond the first side 24, as illustrated in FIG. 15. As an alternative, it is also conceivable for the bar 14 not to project, or not substantially to project, beyond the first side 24 (not illustrated).

Figure 16:
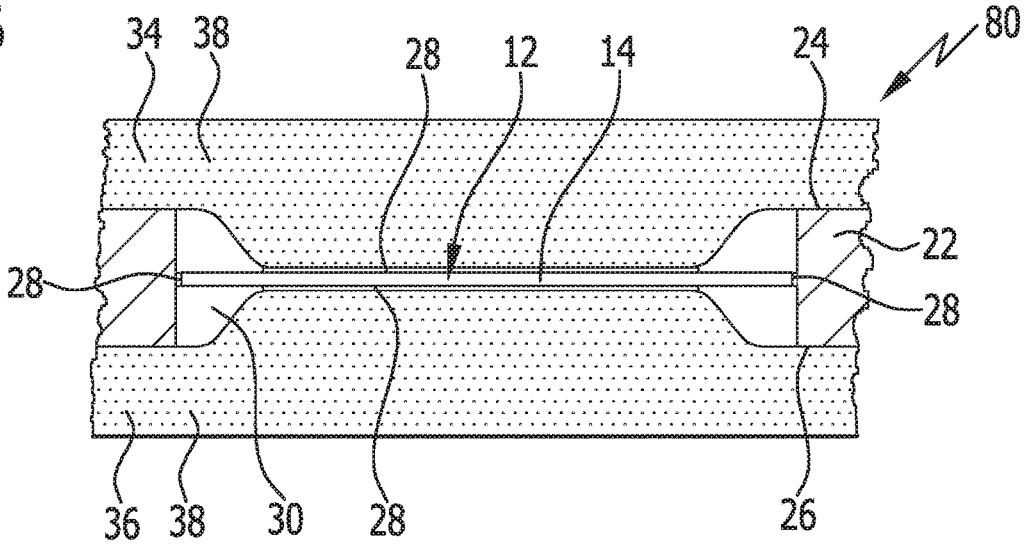
FIG. 16 shows a representation corresponding to FIG. 3, in a fourth preferred embodiment.

In the case of a handling device 80, represented partly in sectional view in FIG. 16, the bar 14 is arranged within the through opening 30. The bar 14 is fixed to the carrier element 22 at the outer periphery, for example by adhesive 28. Because of the thickness of the bar 14, which is usually smaller than that of the carrier element 22, it is provided for the bar 14 not to project beyond the side 24 or the side 26. It may be provided for the bar 14 to be connected by adhesion to at least one of the foils 38, both of which may engage in certain sections in the through openings 30 (FIG. 16).

Figure 17:
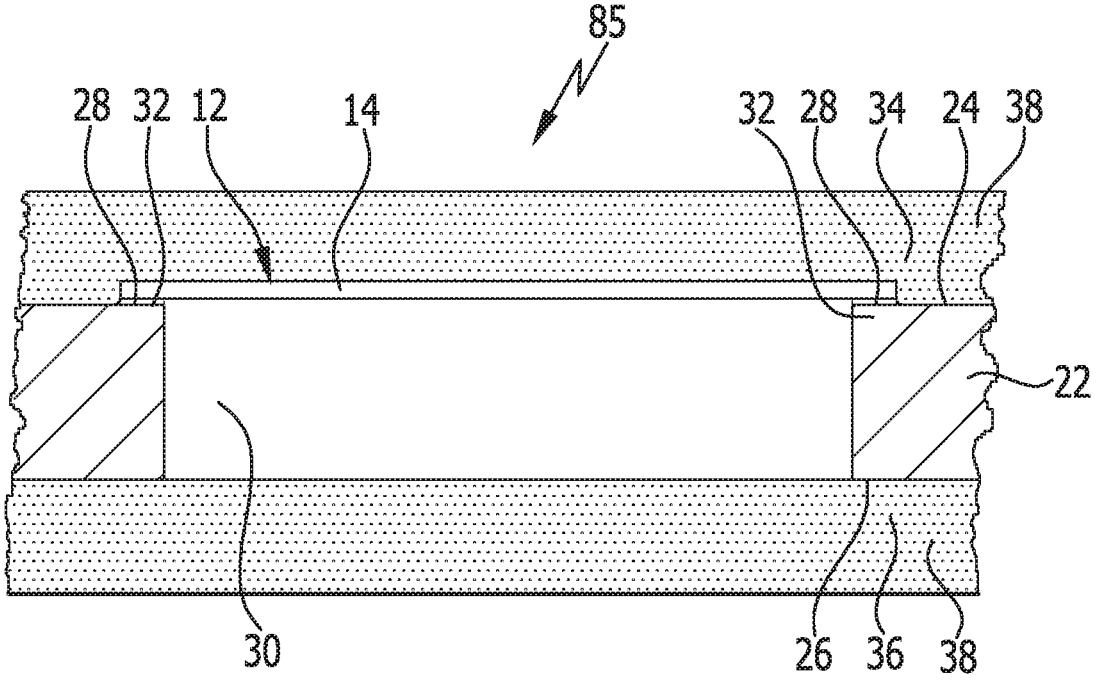
FIG. 17 shows a representation corresponding to FIG. 3, in a fifth preferred embodiment.

In the case of a handling device 85, represented partly in sectional view in FIG. 17, the difference from the handling device 10 consists in the fact that the cover element 36 does not engage in the through opening 30 on the second side 26. Advantageously, the cover element 36 takes the form of a transparent foil 38 that undergoes only negligible plastic deformation when it is applied. The bar 14 in the handling device 85 is connected to the carrier element 22 by adhesion at the rim 32 and is covered on the first side 24 by the foil 38.

It may be provided for cover elements 36 that are of a nature such that they do not engage in the through opening 30 likewise to be used in the handling devices 70 and 80 in accordance with FIGS. 15 and 16.

Figure 18:
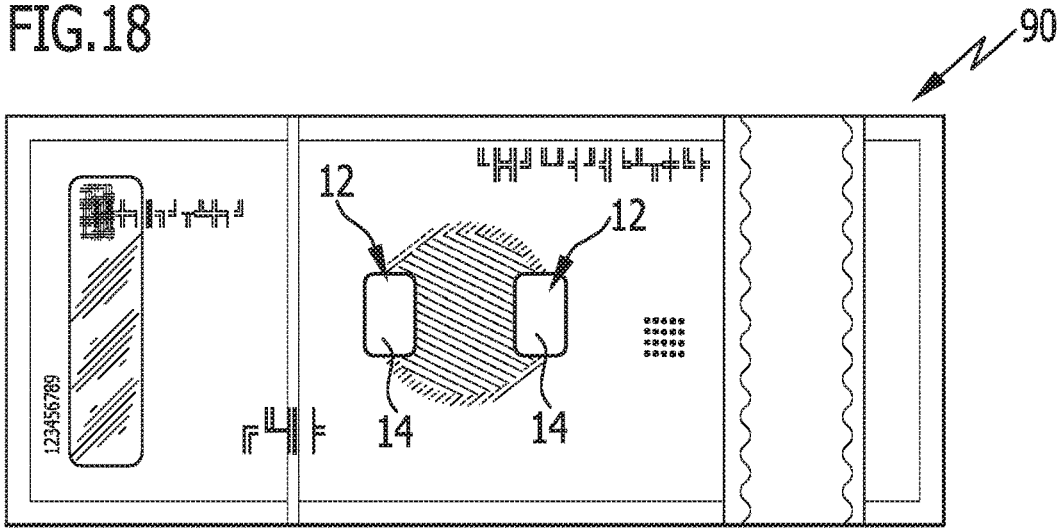
FIG. 18 shows a representation corresponding to FIG. 1, in a sixth preferred embodiment.
Figure 19:
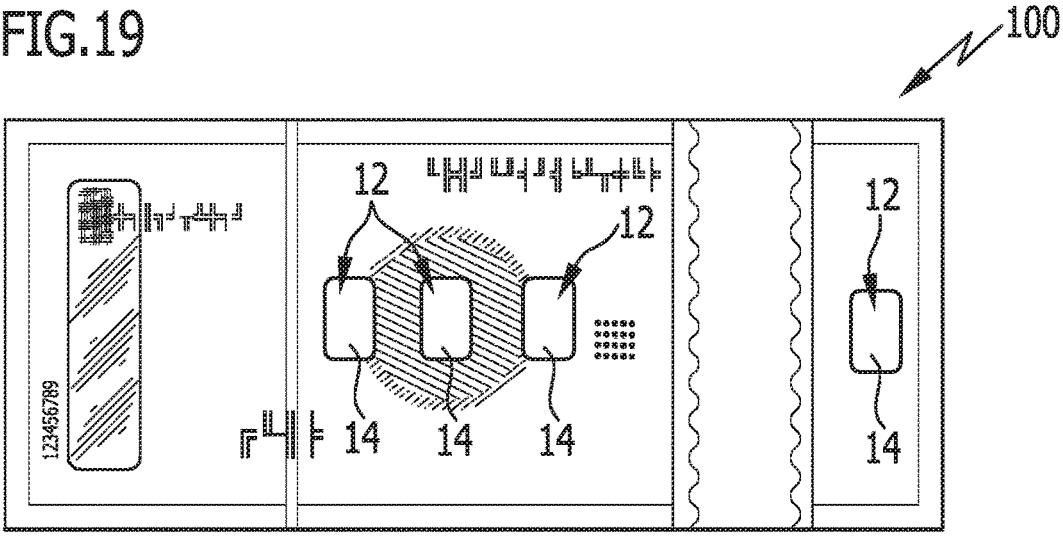
FIG. 19 shows a representation corresponding to FIG. 1, in a seventh preferred embodiment.
Figure 20:
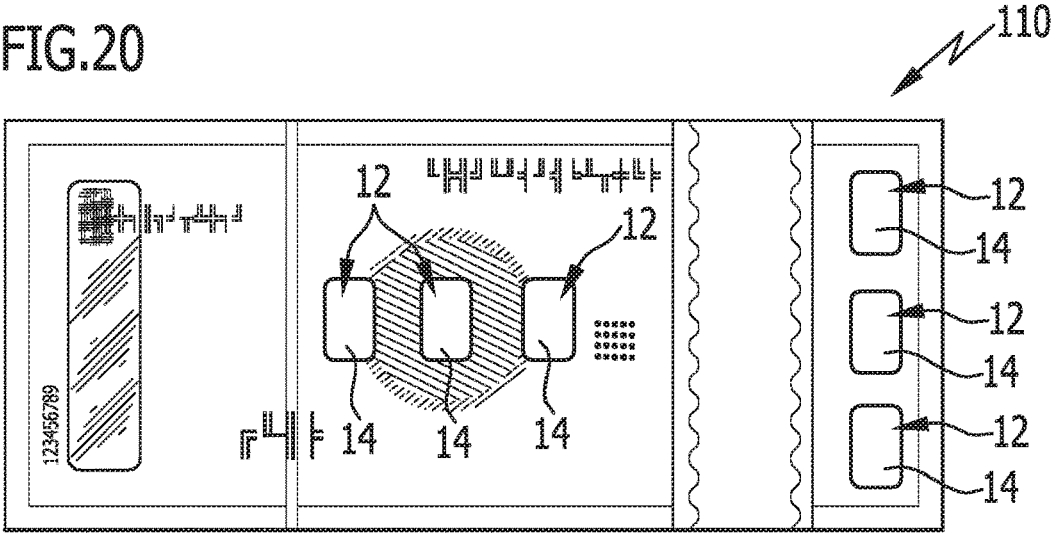
FIG. 20 shows a representation corresponding to FIG. 1, in an eighth preferred embodiment.

In FIGS. 18, 19 and 20, handling devices that are designated by the reference numerals 90, 100 and 110 are illustrated in a manner corresponding to FIG. 1. Whereas the handling device 10 has only one valuable article 12 in the form of a bar 14, the handling devices 90, 100 and 110 include a plurality of valuable articles 12. These could also be positioned on the carrier element 22 in a manner other than that represented in the drawing.

The handling device 90 comprises two valuable articles 12 that are identical in form and, in the present case, are each formed by a gold bar 14.

The handling device 100 comprises four valuable articles 12 that are identical in form and, in the present case, are each formed by a gold bar 14.

The handling device 110 comprises six valuable articles 12 that are identical in form and, in the present case, are each formed by a gold bar 14.

In the case of the handling devices 90, 100 and 110, the bars 14 are each fixed to the carrier element 22, as in the case of the handling device 10. Of course it is also possible to provide for the securing variants described with reference to the handling devices 60, 70, 80 and 85 in FIGS. 14 to 17 to be used in variants of the handling devices 90, 100 and 110.

Figure 21:
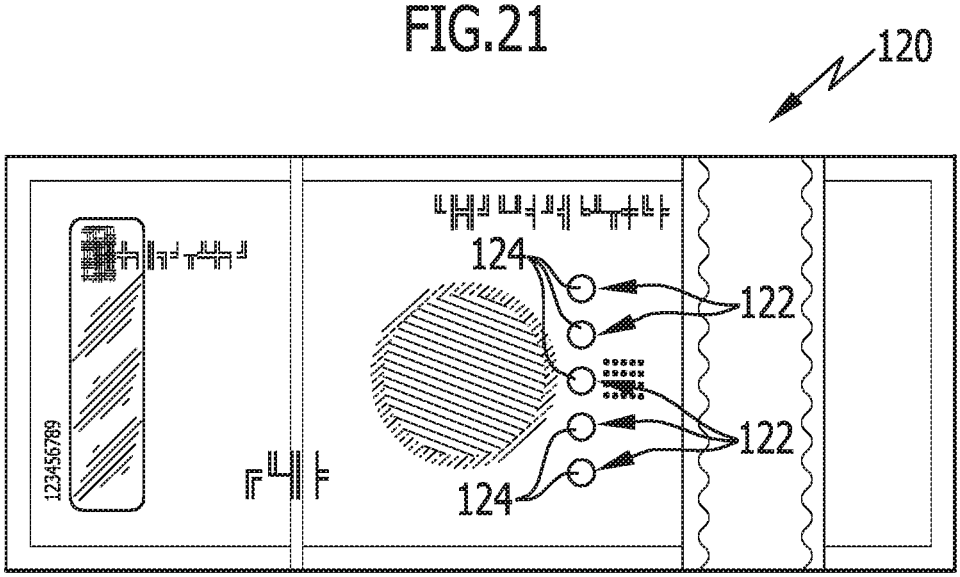
FIG. 21 shows a representation corresponding to FIG. 1, in a ninth preferred embodiment.

FIG. 21 shows a handling device that is designated by the reference numeral 120, in a manner corresponding to FIG. 1.

Instead of the bar 14 as the valuable article 12, a plurality of valuable articles 122 that are each punctiform is provided. The valuable articles 122 are formed by a precious metal, in particular gold, specifically fine gold. Instead of the bars 14 in strip form, dots 124 are used, for example having the size of a pinhead. Otherwise, the reader is referred to the remarks above.

Figure 22:
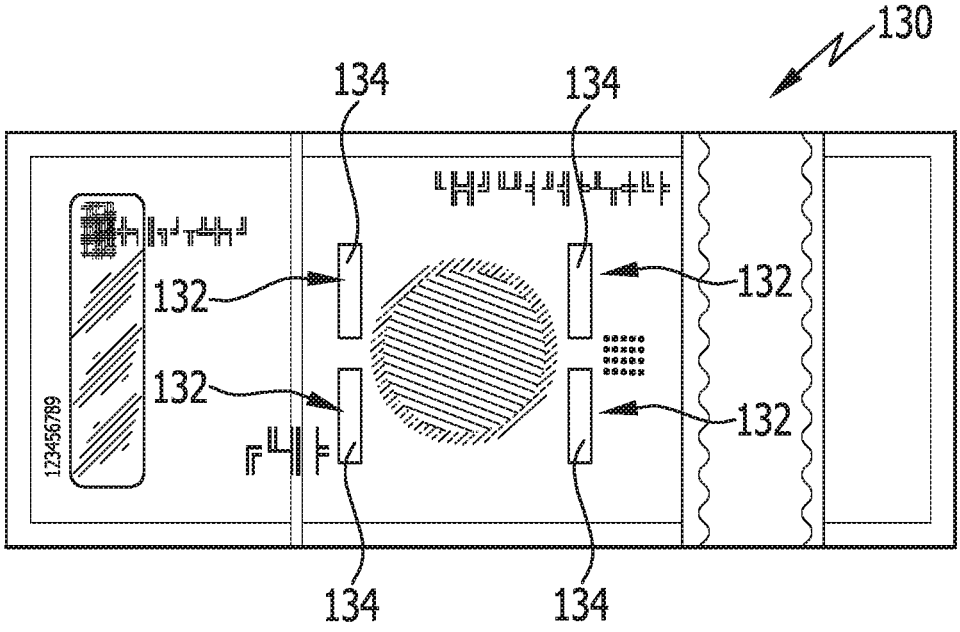
FIG. 22 shows a representation corresponding to FIG. 1, in a tenth preferred embodiment.

A handling device that is illustrated in FIG. 22 and is designated by the reference numeral 130 is shown in a manner corresponding to FIG. 1. Here, valuable articles 132 are used which are likewise bars 134 that are formed by a precious metal, such as in particular gold, specifically fine gold.

Unlike the bars 14, the bars 134 are of a relatively elongate rectangular shape, that is to say are formed in the shape of thin, narrow strips.

Both the dots 124 and the bars 134 are flat and, in their direction within the plane of the handling device, have dimensions that markedly exceed the thickness in a plane perpendicular to the handling device.

REFERENCE NUMERALS

10 Handling device
12 Valuable article
14 Bar
16 Identifier
18 Information
20 Certification
22 Carrier element
24 First side
26 Second side
28 Adhesive
30 Through opening
32 Rim
34 Cover element
36 Cover element
38 Foil
40 Character string
42 Decoration
44 Identification feature
46 Serial number
48 Watermark
50 Hologram
52 Marking element
54 Sheet
60 Handling device
70 Handling device
72 Shoulder
80 Handling device
85 Handling device
90 Handling device
100 Handling device

110 Handling device
120 Handling device
122 Valuable article
124 Dot
130 Handling device
132 Valuable article
134 Bar

What is claimed is:

1. A handling device for a valuable article of flat extent, the valuable article being a precious metal, the handling device comprising:

a carrier element of flat extent comprising a first side and a second side opposite the first side, and at least one valuable article fixed to the first side of the carrier element, the carrier element being foldable, rollable, and bendable, the carrier element having at least one through opening, to a rim of which the at least one valuable article is fixed on a surface of the carrier element, the at least one valuable article extending over the at least one through opening so as to allow recognition of the at least one valuable article from both the first side and the second side of the carrier element, at least one transparent cover element that covers the first side of the carrier element and the at least one valuable article on the first side of the carrier element, wherein:

the handling device comprises or forms an analyzable marking element that is applied beneath the cover element and is indicative of an origin of the handling device, the marking element being analyzable by at least one of chemical and physical analysis; and the marking element is or comprises an S-DNA element.

2. The handling device in accordance with claim 1, wherein the carrier element takes a rectangular form in plan view.

3. The handling device in accordance with claim 1, wherein the carrier element is made from a paper material or is formed as a plastics foil.

4. The handling device in accordance with claim 1, wherein the at least one valuable article is in strip form.

5. The handling device in accordance with claim 1, wherein the at least one valuable article is chemically inert.

6. The handling device in accordance with claim 1, wherein the precious metal comprises a bar of gold or platinum.

7. The handling device in accordance with claim 1, wherein a mass of the precious metal is approximately 0.025 g to 0.5 g.

8. The handling device in accordance with claim 1, wherein a thickness of the precious metal is approximately 5 μm to 60 μm.

9. The handling device in accordance with claim 1, wherein the at least one valuable article has an identifier indicating at least one of a value and an origin of the at least one valuable article to a user.

10. The handling device in accordance with claim 1, wherein the at least one valuable article comprises a plurality of valuable articles.

11. The handling device in accordance with claim 1, wherein the at least one valuable article is fixed to the carrier element by adhesion.

12. The handling device in accordance with claim 1, wherein the at least one valuable article is non-detachably or detachably fixed to the carrier element.

13. The handling device in accordance with claim 1, wherein there is a plurality of valuable articles and a plurality of through openings, a respective through opening being associated with a respective valuable article.

14. The handling device in accordance with claim 1, wherein the at least one valuable article is arranged on the carrier element such that the valuable article does not project, or does not substantially project, beyond a surface of the carrier element.

15. The handling device in accordance with claim 1, wherein the at least one transparent cover element comprises a further transparent cover element covering the second side of the carrier element opposite the first side of carrier element.

16. The handling device in accordance with claim 1, wherein the at least one cover element is formed by a foil that is applied to the carrier element.

17. The handling device in accordance with claim 1, wherein the handling device comprises an identification feature by means of which the handling device is unambiguously identifiable.

18. The handling device in accordance with claim 1, wherein the identification feature is formed by a serial number that is applied to the carrier element.

19. The handling device in accordance with claim 1, wherein the carrier element comprises at least one watermark.

20. The handling device in accordance with claim 1, wherein the handling device has at least one hologram or kinegram.

21. The handling device in accordance with claim 20, wherein the at least one hologram or kinegram is applied to a transparent cover element that is applied to the carrier element.

22. The handling device in accordance with claim 1, wherein the handling device is foldable, rollable and bendable.

23. The handling device in accordance with claim 15, wherein the further transparent cover element one of: engages in the at least one through opening from the second side of the carrier element; and engages with adhesive applied to the valuable article through the at least one through opening.

24. The handling device in accordance with claim 1, wherein the at least one transparent cover element covers an entirety of the first side of the carrier element and the at least one valuable article.

25. A method for manufacturing at least one handling device for a valuable article, the valuable article being a precious metal of flat extent, the method comprising:

providing a carrier element of flat extent that is foldable, rollable, and bendable;

providing and fixing at least one valuable article to the carrier element;

applying an optically transparent cover element to the carrier element on at least one side of the carrier element, such that the cover element covers the at least one valuable article and the marking element, and applying an analyzable marking element beneath the cover element that is indicative of an origin of the handling device, the marking element being analyzable by at least one of chemical and physical analysis, wherein:

a plurality of handling devices is manufactured such that a multiplicity of carrier elements is provided on a sheet;

after respective at least one valuable article has been fixed to the respective carrier element, the sheet is divided into individual handling devices; and the marking element is or comprises an S-DNA element.

26. The method in accordance with claim 25, wherein the precious metal comprises a bar of gold or platinum.

27. The method in accordance with claim 25, wherein the at least one valuable article is fixed to the respective carrier element by adhesion.

28. The method in accordance with claim 25, wherein the cover element is formed by laminating a foil onto the carrier element.

29. The method in accordance with claim 25, wherein an analyzable marking element, indicative of an origin of the handling device, is applied to the carrier element.

30. The method in accordance with claim 25, wherein at least one hologram or kinegram is applied, on at least one transparent cover element applied to the carrier element.

31. The method in accordance with claim 25, wherein, before fixing the at least one valuable article to the respective carrier element, a through opening is formed in the respective carrier element, the valuable article being fixed to a rim of the through opening on a surface of the carrier element so as to extend over the through opening.

32. The method in accordance with claim 25, wherein the cover element is applied to the sheet of carrier elements with the valuable articles fixed thereto before the sheet is divided into individual handling devices.

33. The method in accordance with claim 25, wherein the at least one transparent cover element covers an entirety of the first side of the carrier element and the at least one valuable article.

34. A handling device for a valuable article of flat extent, the valuable article being a precious metal, the handling device comprising:

a carrier element of flat extent comprising a first side and a second side opposite the first side, and at least one valuable article fixed to the first side of the carrier element, the carrier element being foldable, rollable, and bendable, the carrier element having at least one through opening, to a rim of which the at least one valuable article is fixed on a surface of the carrier element, the at least one valuable article extending over the at least one through opening so as to allow recognition of the at least one valuable article from both the first side and the second side of the carrier element, at least one transparent cover element that covers the first side of the carrier element and the at least one valuable article on the first side of the carrier element, wherein:

the handling device comprises or forms an analyzable marking element that is applied to the carrier element and is indicative of an origin of the handling device, the marking element being analyzable by at least one of chemical and physical analysis; and the marking element is or comprises an S-DNA element.

* * * * *